US012534986B2

(12) United States Patent
Valbuena Fuenmayor et al.

(10) Patent No.: US 12,534,986 B2
(45) Date of Patent: Jan. 27, 2026

(54) MULTIPLE-CONDUIT PRODUCTION STRING COMPLETION

(71) Applicant: Saudi Arabian Oil Company, Dhahran (SA)

(72) Inventors: Jose Daniel Valbuena Fuenmayor, Dhahran (SA); Fatimah AlNasser, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 103 days.

(21) Appl. No.: 18/494,516

(22) Filed: Oct. 25, 2023

(65) Prior Publication Data

US 2025/0137362 A1 May 1, 2025

(51) Int. Cl.
*E21B 43/12* (2006.01)

(52) U.S. Cl.
CPC ..... *E21B 43/12* (2013.01)

(58) Field of Classification Search
CPC ..... E21B 43/12
See application file for complete search history.

(56) References Cited

U.S. PATENT DOCUMENTS 2,678,605 A * 5/1954 Tappmeyer ..... E21B 43/122 166/54.1
7,473,844 B2 1/2009 Figenschou et al.
9,470,076 B2 10/2016 Edwards et al.
2005/0217747 A1* 10/2005 Buriak ..... B32B 1/08 138/140
2006/0137881 A1* 6/2006 Schmidt ..... E21B 43/123 166/372
2012/0006444 A1 1/2012 Tupper et al.
2022/0154561 A1* 5/2022 Becker ..... E21B 43/123
2022/0220840 A1* 7/2022 Hebert ..... E21B 47/007

FOREIGN PATENT DOCUMENTS

WO WO-2023146408 A1 * 8/2023 ..... E21B 17/04

OTHER PUBLICATIONS

Lea, James F., and Henry V. Nickens. "Solving Gas-Well Liquid-Loading Problems." J Pet Technol 56 (2004): 30-36. doi: https://doi.org/10.2118/72092-JPT (Year: 2004).*
[No Author Listed], "Production Technology Study Guide," Department of Petroleum Engineering, Heriot-Watt University, Chapter 7, (Specifically Figure 4), Apr. 1999, 17 pages.
(Continued)

*Primary Examiner* — Crystal J Lee
(74) *Attorney, Agent, or Firm* — Fish & Richardson P.C.

(57) ABSTRACT

A production string includes one or more segments each including a solid core defining a plurality of non-intersecting production conduits. Flow through the conduits can be selected such that, as a first instance, substantially all of the fluid flowing from the subterranean zone to the surface location is permitted to flow through one or more of the plurality of production conduits. In response to a liquid loading event, as a second instance, flow is prevented through at least one of the plurality of production conduits, such that a total cross-sectional area of the production conduits in the second instance is less than a total cross-sectional area of the production conduits in the first instance.

9 Claims, 4 Drawing Sheets

(56) References Cited

OTHER PUBLICATIONS

[No Author Listed], "Multi-Zone Completions, Dual String Completion: Tri-Zone," Select Energy Systems, Inc., Figure 5, 2008, p. 18.
drillingmanual.com [online], "Select Energy Systems Multi-Zone Completion Brochure," Jan. 17, 2023, retrieved on May 23, 2024, retrieved from URL<https://www.drillingmanual.com/multiple-zone-completion/#multiple-string-multiple-packer->, 11 pages.
Kiser, "Flatpack" Brochure, CJS Coiled Tubing Supply, Mar. 2011, 20 pages.

* cited by examiner

MULTIPLE-CONDUIT PRODUCTION STRING COMPLETION

TECHNICAL FIELD

This disclosure relates to the production of oil, gas, or other resources from subterranean zones to the surface.

BACKGROUND

Hydrocarbons or other fluids in subsurface reservoirs or locations below the Earth's surface can be produced to the surface via wells drilled from the surface to the subsurface locations. After drilling, such wells are typically completed by disposing a string of casing into the wellbore and cementing the casing in the wellbore by introducing cement into the annular space between the wellbore and the casing. The casing can then be perforated at the downhole location or locations corresponding to the reservoirs or reservoir layers from which production is desired or expected. A production tubing disposed within the casing provides a pathway for the produced fluids to flow to the surface.

In gas wells, a phenomenon called "liquid loading" can occur, in which the flow rate of the gas is not high enough to lift liquids (e.g. water and/or condensate) to the surface. Over time, the increasing presence of liquid in the well can hinder or stop gas production. In some circumstances, a small-diameter tubing string-known as a velocity string-can be run inside the well as a remedial treatment to resolve liquid-loading problems. The velocity string reduces the flow area and increases the flow velocity to enable liquids to be carried from the wellbore. Deployment of a velocity string typically involves removing and replacing a production string with one of a smaller diameter, or inserting a small-diameter velocity string within the main conduit of a production string.

Likewise, over a life of the well, scaling or other material can cause partial or full blockage of production flow conduits that can likewise hinder or stop fluid production. Remediating such blockage can involve the removal and replacement of production tubing.

SUMMARY

Certain aspects of the subject matter herein can be implemented as a system for flowing to a surface location produced fluid from a wellbore drilled into a subterranean zone. The system includes a casing string disposed in the wellbore and a production string disposed concentrically and coaxially within the casing string. The production string includes one or more segments each including a cylindrical, one-piece, solid core extending substantially the length of the segment and defining a plurality of non-intersecting production conduits extending in parallel through the solid core, through which can flow fluid flowing from the subterranean zone to the surface. The system is configured to individually and selectively permit fluid flow through one or more of the plurality of production conduits such that, as a first instance of produced fluid flow, substantially all of the fluid flowing from the subterranean zone to the surface location is permitted to flow to the surface location through one or more of the plurality of production conduits, and, in response to an indication of a liquid loading event, as a second instance of produced fluid flow after the first instance, flow is prevented through at least one of the plurality of production conduits through which flow was permitted in the first instance, such that a total cross-sectional area of the production conduits through which substantially all of the fluid flowing from the subterranean zone to the surface is permitted to flow in the second instance is less than a total cross-sectional area of the production conduits through which substantially all of the fluid flowing from the subterranean zone to the surface was permitted to flow in the first instance.

Certain aspects of the subject matter herein can be implemented as a method including disposing a production string concentrically and coaxially within a casing string disposed in a wellbore drilled into a subterranean zone. The production string includes one or more segments each comprising a cylindrical, one-piece, solid core extending substantially the length of the segment and defining a plurality of non-intersecting production conduits extending in parallel through the solid core. The method includes permitting, as a first instance of produced fluid flow, substantially all of the fluid flowing from the subterranean zone to flow through one or more of the plurality of production conduits to a surface location and, in response to an indication of a liquid loading event, as a second instance of produced fluid flow after the first instance, preventing flow through at least one of the plurality of production conduits through which flow was permitted in the first instance, such that a total cross-sectional area of the production conduits through which substantially all of the fluid flowing from the subterranean zone is permitted to flow to the surface location in the second instance is less than a total cross-sectional area of the production conduits through which substantially all of fluid flowing from the subterranean zone surface was permitted to flow to the surface location in the first instance.

Certain aspects of the subject matter herein can be implemented as a method including disposing a production string in a wellbore, the production string comprising one or more segments each comprising a cylindrical, one-piece, solid core extending substantially the length of the segment and defining a plurality of non-intersecting production conduits extending in parallel through the solid core. The method further includes permitting, as a first instance of produced fluid flow, at least a portion of a main flow of fluid produced from the subterranean zone to flow through a first one of the plurality of production conduits to a surface location while preventing flow through at least a second one of the plurality of production conduits and, in response to an indication of a flow reduction event, as a second instance of produced fluid flow after the first instance, permitting flow through at least the second one of the plurality of production conduits to the surface location.

The details of one or more embodiments are set forth in the accompanying drawings and the description below. Other features, objects, and advantages will be apparent from the description and drawings, and from the claims.

DETAILED DESCRIPTION

The details of one or more implementations of the subject matter of this specification are set forth in this detailed description, the accompanying drawings, and the claims. Other features, aspects, and advantages of the subject matter will become apparent from this detailed description, the claims, and the accompanying drawings.

In accordance with embodiments of the present invention, an improved method and system for the production of fluids from a subterranean zone is disclosed. In an embodiment of the present disclosure, production string segments include one-piece, solid core extending substantially the length of the segment and defining a plurality of non-intersecting production conduits extending in parallel through the solid core. A completion system can be configured so as to individually and selectively permit fluid flow through one or more of the plurality of production conduits. Thus, the production string can act as both a main production conduit and also a velocity string. Liquid loading problems can be addressed while reducing or eliminating the need to remove the production string, or to place within the production string a separate velocity string. In addition, because additional or alternate production conduits can be included within the same production string, conduits can be kept "in reserve" to be opened for flow in the event of scaling within the conduits or other flow disturbances. The simple solid body construction provides fewer pathways through which undesirable leakage of pressure or fluids or other mechanical complications can occur. In some embodiments, the solid body can be formed using an additive manufacturing process. The system can utilize standard packers and other completion apparatus designed for conventional production tubing and can be deployed without (or with a minimum of) costly workover operations, using fewer and less complicated surface deployments system and method steps than conventional methods and systems. Thus, efficiency and production can be increased while reducing operational cost.

Figure 1:
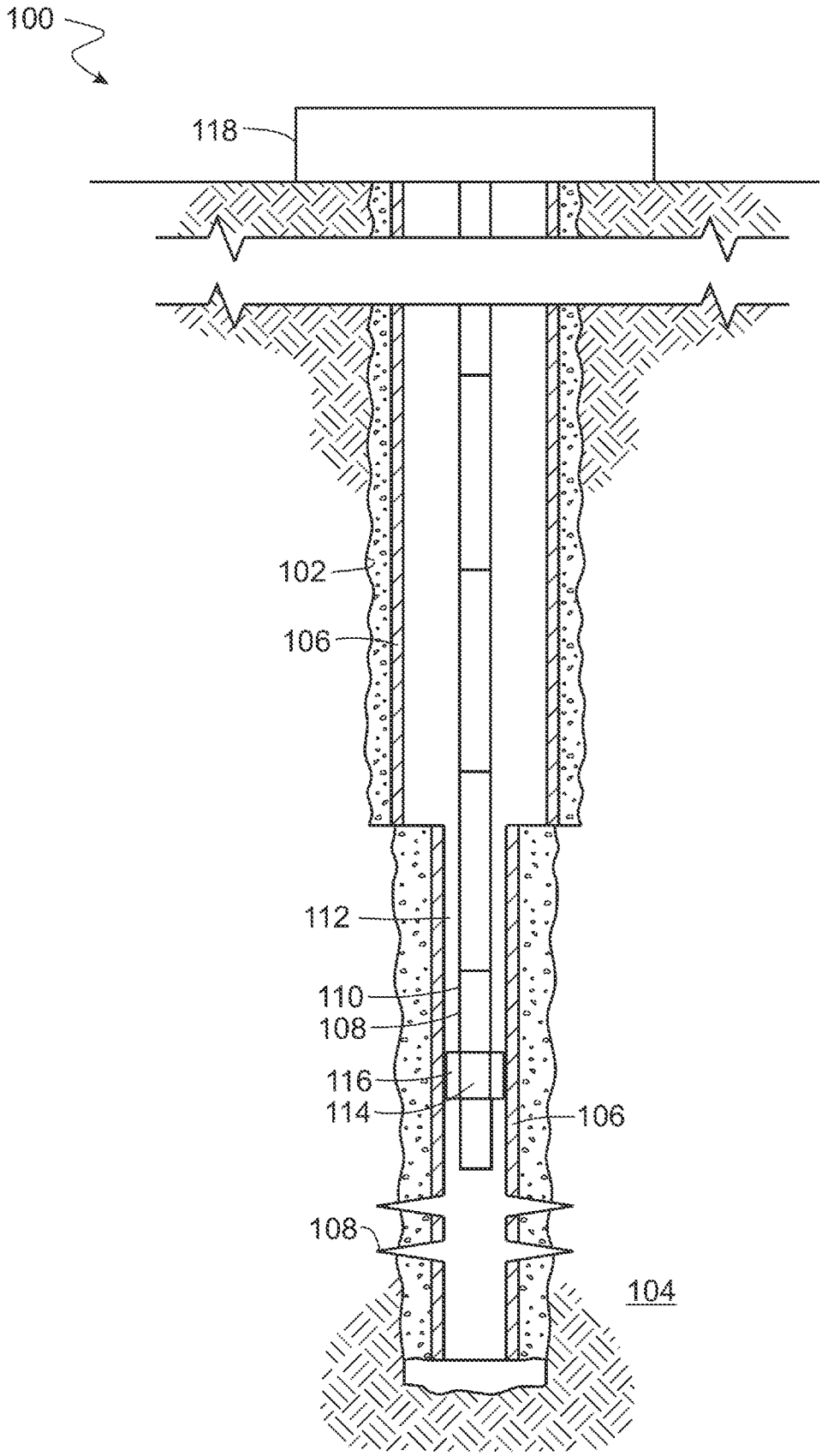
FIG. 1 is a schematic illustration of well system in accordance with an embodiment of the present disclosure.

FIG. 1 is a schematic illustration of well system 100 in accordance with an embodiment of the present disclosure. Referring to FIG. 1, well system 100 that includes a substantially cylindrical wellbore 102 extending into the Earth into a subterranean zone 104. Wellbore 102 is shown as extending substantially vertically from the surface through the subterranean zone; however the concepts described here can be applicable to many different configurations of wells, including vertical, horizontal, slanted, or wells that are otherwise non-horizontal, partially or fully, with respect to the surface and/or with respect to the intervals.

After some or all of the wellbore 102 is drilled, a portion of the wellbore 102 can be lined with lengths of casing string 106. Casing string 106 can be installed in segments by lowering a first length of casing into place and then cementing the annulus by injecting a cement slurry downhole through central bore of the casing, such that the cement slurry then travels uphole within the annulus and hardens. After installation and cementing of the length of casing, a second, smaller-diameter length can be lowered within the first casing length and cemented into place. Subsequent lengths of casing can likewise be installed in progressively lower sections. In some embodiments, a well completion can include multiple casing segments that nested concentrically within each other and extending partially or fully along the length of the wellbore. In the illustrated embodiment, perforations 108 through casing string 106 allow hydrocarbons or other fluids to enter wellbore 102 from subterranean zone 104.

After installation and perforation of the casing string 106, a production string 110 can be installed in wellbore 102, concentrically and coaxially within the casing string 106. In some embodiments, casing perforation can occur before, simultaneously with, or after installation of production string 110. Production string 110 acts as the primary pathway through which fluids are produced to the surface.

Figure 2:
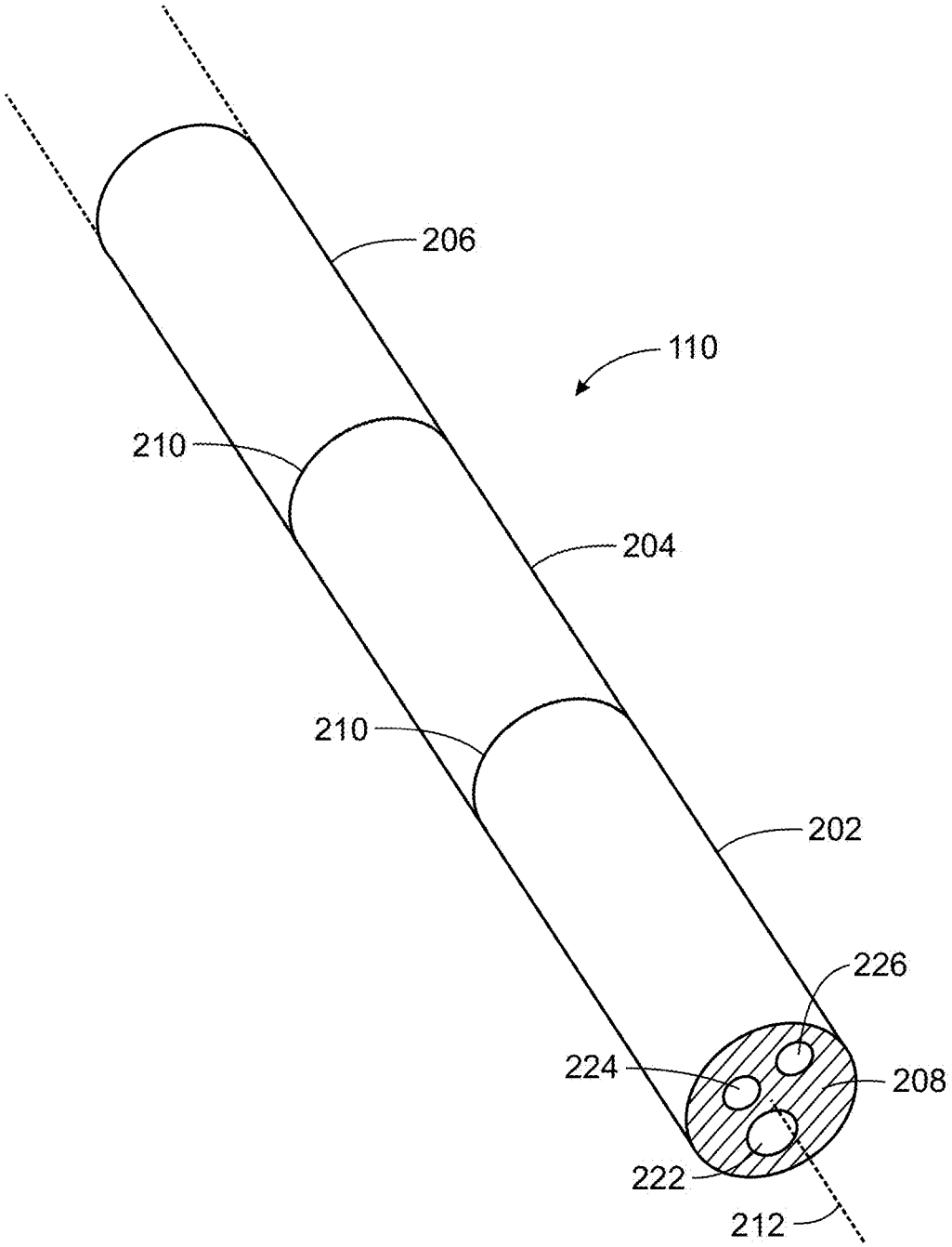
FIG. 2 is a schematic illustration of a production tubing string in accordance with an embodiment of the present disclosure.

As shown in FIG. 2, production string 110 can be made up of one or more segments, each comprising a cylindrical, one-piece, solid core 208 extending substantially the length of the segment. Three such segments are shown in FIGS. 2: 202, 204, and 206; however, some embodiments can include a lesser or greater number of segments. In the illustrated embodiment, solid core 208 in turn defines a plurality of non-intersecting production conduits extending in parallel through the solid core through which can flow fluid flowing from the subterranean zone to the surface. Three such production conduits (222, 224, and 226) are shown in FIG. 2; other embodiments can include a greater or lesser number of production conduits (for example two or four conduits). Production string segments can be connected in series with connectors 210, which can be a threaded connections or other suitable connection types. In some embodiments, individual segments can be installed as tubing joints connected via threaded corrections using a specified torque to aligns the production conduits. In some embodiments, one or more of the segments of production string 110 (with production conduits 222, 224, and 226) comprises coiled tubing. For example, in some embodiment, production string 110 can comprise only one segment comprising a single, continuous length of coiled tubing (with inner production conduits) extending from the surface to the downhole end of the production string.

Solid core 208 in some embodiments can be composed of reinforced thermoplastic, carbon steel, or another suitable material. In some embodiments, solid core 208 can be formed using an additive manufacturing (3-D printing) process. Additive manufacturing can allow the manufacturing of conduit diameters to specific sizes and numbers depending of the design. The additive manufacturing can be, for example, with a metallic material or a composite material that can withstand the well operating conditions of each oil & gas field. Alternatively, conduits could be manufactured individually using conventional tubing or coiled tubing manufacturing processes, then assembled together inside a main tubing, with the space between the conduits filled with a material such an expanding foam.

Referring again to FIG. 1, in the illustrated embodiment, well system 100 further includes a surface facility 118, which can include a wellhead including various spools, valves, and adapters to provide pressure and flow control from wellbore 102. Surface facility 118 can further include apparatus for selectively permitting and preventing fluid flow through individual production conduits 222, 224, and 226. For example, the selective open/closure could be accomplished by inserting a plug or dropping a ball into the individual conduits. Tubing 110 can be hung in a manner similar to conventional production tubing. In some embodiments, the surface hanger assembly from which the tubing is hung can include seats with individual plugs (similar to back-pressure valves). Sealing balls or valves in the conduit seat can be installed with appropriate lubricators and setting tools. In some embodiments, a multi-conduit hanger can employ remotely operated or automated valves for opening and closing of the conduits.

As further shown in FIG. 1, the outer surface of production tubing string 110 and the inner surface of casing string 106 forms an annulus 112. In the illustrated embodiment, one or more packers 114 are installed on production string 110. When activated, packing elements 116 press circumferentially against an inner surface of the casing string 106, sealing and isolate the annulus 112 above packer 114 from annulus 112 below packer 114. In the illustrated embodiment, central axis 212 of solid core 208 (shown in FIG. 2) is coincident with the central axis of the production string 110, such that the alignment caused by the actuation of the packing elements 116 aligns central axis 212 of the solid core 208 (shown in FIG. 2) to be coincident with a central axis of the casing string 106, and the diameter of the solid body 208 can be substantially the same as the diameter of a standard production packer. Thus, packer 114 can comprise a standard production packer such as a mechanical packer or a swellable packer of the type used for a standard-sized production string. Because the conduits are defined by cylindrical solid body 208 around which such a standard packer can be placed, specialized, multi-conduit packers are not required for the completion shown in FIG. 1. In some embodiments, no packer is installed on the production string.

Figure 3:
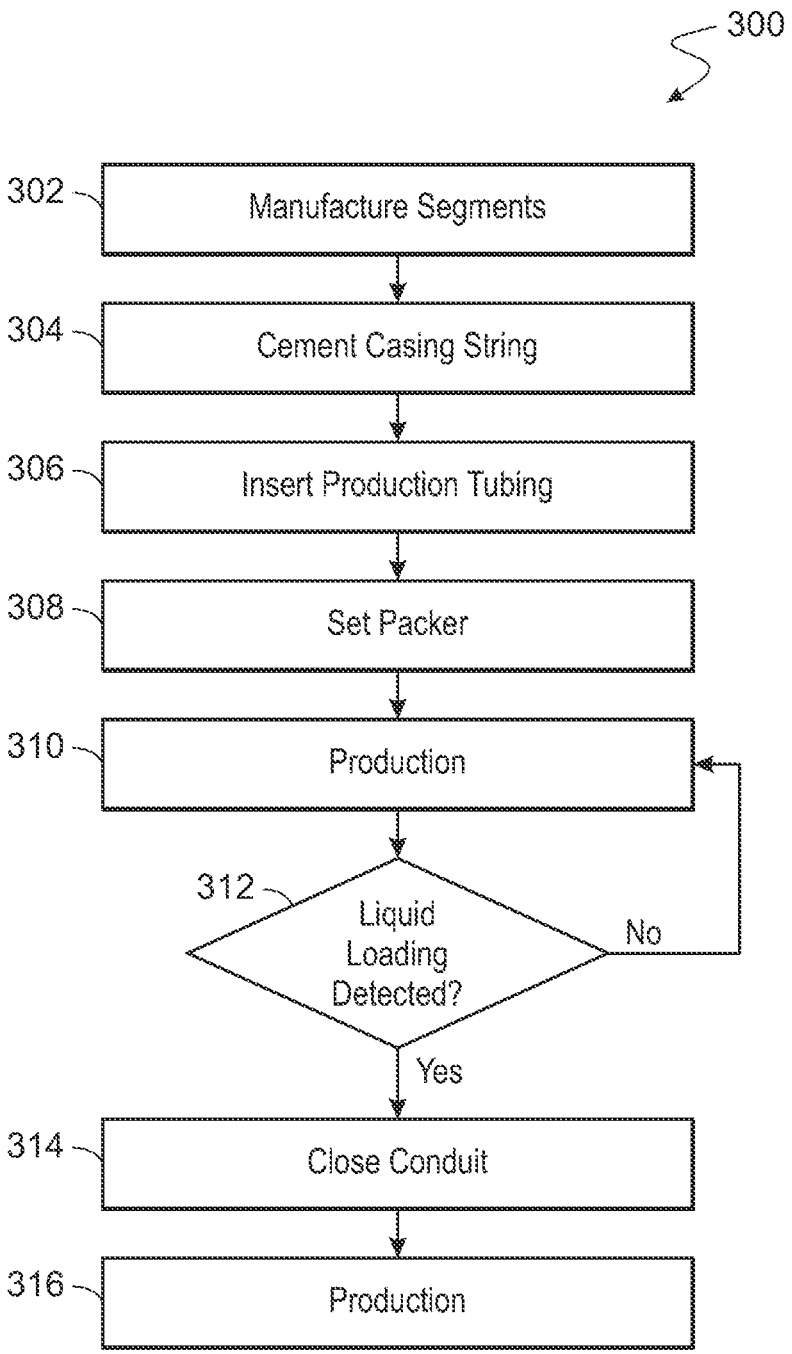
FIG. 3 is a process flow diagram of a method of producing fluids from a subterranean zone in accordance with embodiments of the present disclosure.

FIG. 3 is a process flow diagram of a method of producing fluids from a subterranean zone in accordance with embodiments of the present disclosure. A method begins at step 302 in which the production tubing segments including the solid body defining the multiple conduits is manufactured and assembled. Such manufacturing can include, for example, forming of the solid by an additive manufacturing process such as that described above. As described above, the segments can each comprising a cylindrical, one-piece, solid core extending substantially the length of the segment and defining a plurality of non-intersecting production conduits extending in parallel through the solid core.

At step 304, the casing string can be disposed into the wellbore and cemented. Proceeding to step 306, the segments are assembled as a production string as they are disposed in the wellbore, within the cemented casing string, concentrically and coaxially within the casing string. At step 308, a production packer is set, isolating the annulus between the production string and the casing above and below the packer and aligning the production string such that a central axis of the solid core is coincident with a central axis of the casing string.

At step 310, production commences. In the course of normal well production, the produced fluid flows through a selected production conduit (or selected set of production conduits. The method then proceeds to step 312 and, so long as no indication of liquid loading arises during production, the method returns to production step 310.

Liquid loading can be detected by, for example, conventional production monitoring (including gas and liquid production measurements) and known analytical methods such as vertical lift performance curves. If at step 312 liquid loading is detected, then the method proceeds to step 314 in which one or more of the conduits that was open during normal production is closed. Production continues at step 316, but the conduit closure has the effect of reducing the total cross-sectional area through which production flows, thus increasing gas velocity and increasing the volume of liquids produced, so in effect causing the production string to transform into a velocity string. As production and production monitoring continues, the desired velocity effect can be continuously adjusted by increasing or decreasing the number of conduits that are closed. In some circumstances, for example, a well stimulation operation can result in a production increase such opening of a conduit may be desired.

In some embodiments, during production, an operator could configure the string such that only one of the conduits is be open (such that flow if permitted through it) while the other conduits remain closed and "in reserve." In response to an indication of scale build up or another partial or full conduit blockage impacting production, one or more of the other conduits can be opened, thus maintaining production at the desired levels.

Figure 4A:
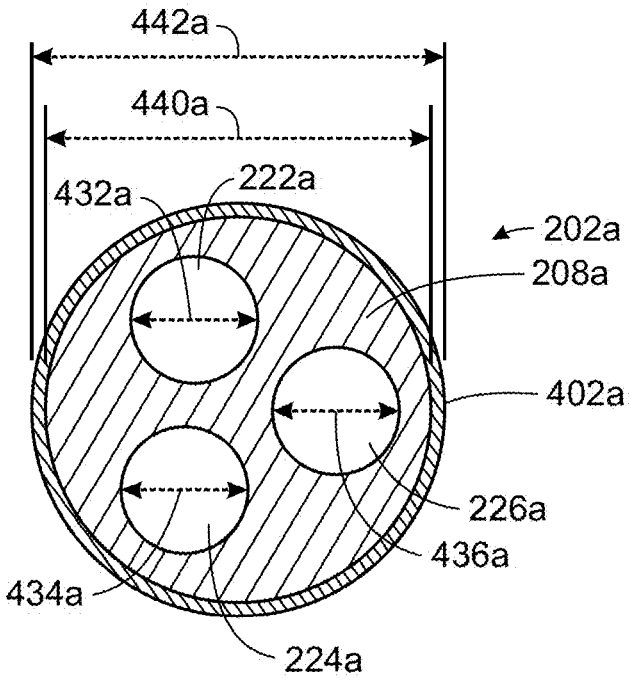
FIGS. 4A and 4B are schematic cross-sectional illustrations of production tubing in accordance with different embodiments of the present disclosure.
Figure 4B:
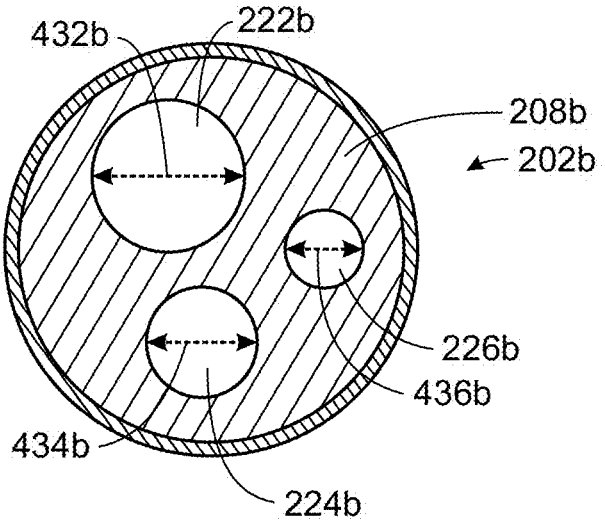

FIGS. 4A and 4B are cross-sectional schematic illustrations of a production tubing segment in accordance with embodiments of the present disclosure. Referring first to FIG. 4A, segment 202 includes solid body 208*a*. Diameter 442*a* of segment 202*a* can be the same or substantially the same as a standard production tubing, thus allowing annular isolation using a conventional production packer. In some embodiments, segment 202*a* can include a sheathing or outer covering solid body 208*a*. In some embodiments, outer covering 402*a* can be relatively thin (or not present) such that diameter 440*a* of the solid body is the same or substantially the same as diameter 442*a*. In the illustrated embodiment, because the production conduits are themselves defined by the solid core 208, the solid core provides a single body of material that surrounds and fills the space between the conduits. In some embodiments, the conduits (i.e., the conduits defined by the solid core) can include tubular liners disposed within them. In some embodiments, at least a portion of the space between the conduits or around the conduits can be components or materials other than the solid core. As described above, closing and opening the individual conduits changes the total cross-sectional area of the conduits available for production flow.

In the embodiment shown in FIG. 4A, diameters 432*a*, 434*a*, and 436*a* of conduits 222*a*, 224*a*, and 226*a*, respectively, are the same or substantially the same. Such a configuration might be preferred if same cross-sectional area of the conduits is desired as the conduits are opened and closed. For example, during initial production, an operator could configure the string such that only one of the conduits (for example, 222*a*) is open (such that flow if permitted through it) while the other conduits remain closed. As scale develops in conduit 222*a*, another conduit (for example, 224*a*) can be opened while closing conduit 222*a*. As scale then subsequently develops in conduit 224*a*, conduit 226*a* can be opened while closing conduit 224*a*. In this way, hindrance of production due to scale build-up can be minimized, but flow rates and other parameters can be kept substantially constant, without removing the production string.

FIG. 4B illustrates a segment (202*b*) including a solid body (208*b*) in accordance with another embodiment of the present disclosure. In contrast to the embodiment shown in FIG. 4A, in the embodiment shown in FIG. 4B diameter 436*b* of conduit 226*b* is smaller than diameter 4344*b* of conduit 224*b*, which in turn is smaller than diameter 432*b* of conduit 222*b*. In accordance with this embodiment, an operator can, for example, address a liquid loading situation by choosing a conduit (or conduits) sized so or sizes most suitable for addressing a liquid loading event, given the well design, flow conditions, and other parameters. For example, during normal operations flow could be permitted through conduit 222*b* (but not through 224*b* or 226*b*). In response to a liquid loading even, conduit 222*b* could be closed and either conduit 224*b* or 226*b* opened. With only the smaller conduit open, the production string acts as a velocity string to address the liquid loading issue.

In this disclosure, "approximately" or "substantially" means a deviation or allowance of up to 10 percent (%) and any variation from a mentioned value is within the tolerance limits of any machinery used to manufacture the part. Likewise, "about" can also allow for a degree of variability in a value or range, for example, within 10%, within 5%, or within 1% of a stated value or of a stated limit of a range.

The term "uphole" as used herein means in the direction along a wellbore from its distal end towards the surface, and "downhole" as used herein means the direction along a wellbore from the surface towards its distal end. A downhole location means a location along a wellbore downhole of the surface.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

EXAMPLES

In a first aspect, a system for flowing to a surface location produced fluid from a wellbore drilled into a subterranean zone includes a casing string disposed in the wellbore and a production string disposed concentrically and coaxially within the casing string. The production string includes one or more segments each including a cylindrical, one-piece, solid core extending substantially the length of the segment and defining a plurality of non-intersecting production conduits extending in parallel through the solid core, through which can flow fluid flowing from the subterranean zone to the surface. The system is configured to individually and selectively permit fluid flow through one or more of the plurality of production conduits such that, as a first instance of produced fluid flow, substantially all of the fluid flowing from the subterranean zone to the surface location is permitted to flow to the surface location through one or more of the plurality of production conduits, and, in response to an indication of a liquid loading event, as a second instance of produced fluid flow after the first instance, flow is prevented through at least one of the plurality of production conduits through which flow was permitted in the first instance, such that a total cross-sectional area of the production conduits through which substantially all of the fluid flowing from the subterranean zone to the surface is permitted to flow in the second instance is less than a total cross-sectional area of the production conduits through which substantially all of the fluid flowing from the subterranean zone to the surface was permitted to flow in the first instance.

In a second aspect according to the first aspect, the system can transition from the first instance to the second instance without removing the production string from the wellbore and without inserting into the wellbore any additional tubing between the first instance and the second instance.

In a third aspect according to the first or the second aspect, the solid core can be an additively formed solid core.

In a fourth aspect according to any of the first to the third aspect, the solid core can comprise reinforced thermoplastic.

In a fifth aspect according to any of the first to the fourth aspect, the solid core can comprise carbon steel.

In a sixth aspect according to any of the first to the fifth aspect, at least one of the one or more segments comprises coiled tubing.

In a seventh aspect according to any of the first to the sixth aspect, a length of a diameter of the solid core can be substantially equal to a length of a diameter of the production string.

In an eighth aspect according to any of the first to the seventh aspect, a cross-sectional area of the solid core plus the cross-sectional area of the plurality of production conduits can be substantially the same as a cross-sectional area of the production tubing string.

In a ninth aspect according to any of the first to the eighth aspect, the preventing the through the at least one of the plurality of production conduits can be by at least one of: inserting a plug into the at least one of the plurality of production conduits; dropping a ball into the at least one of the plurality of production conduits; or closing a valve.

In a tenth aspect according to any of the first to the ninth aspect, the system can further comprise one or more packer elements disposed about the production string and configured such that actuation of packer element presses the packer element circumferentially against an inner surface of the casing string and aligns the production string such that a central axis of the solid core is coincident with a central axis of the casing string.

In an eleventh aspect according to any of the first to the tenth aspect, the plurality of production conduits can comprise conduits of different diameters.

In a twelfth aspect, a method includes disposing a production string concentrically and coaxially within a casing string disposed in a wellbore drilled into a subterranean zone. The production string includes one or more segments each comprising a cylindrical, one-piece, solid core extending substantially the length of the segment and defining a plurality of non-intersecting production conduits extending in parallel through the solid core. The method includes permitting, as a first instance of produced fluid flow, substantially all of the fluid flowing from the subterranean zone to flow through one or more of the plurality of production conduits to a surface location and, in response to an indication of a liquid loading event, as a second instance of produced fluid flow after the first instance, preventing flow through at least one of the plurality of production conduits through which flow was permitted in the first instance, such that a total cross-sectional area of the production conduits through which substantially all of the fluid flowing from the subterranean zone is permitted to flow to the surface location in the second instance is less than a total cross-sectional area of the production conduits through which substantially all of fluid flowing from the subterranean zone surface was permitted to flow to the surface location in the first instance.

In a thirteenth aspect according to the twelfth aspect, the production string can be not removed from the wellbore and no additional tubing can be disposed within the production string between the first instance and the second instance.

In a fourteenth aspect according to the twelfth or the thirteenth aspect, the method can further include forming the solid core by additive manufacturing prior to assembly of the production string.

In a fifteenth aspect according to any of the twelfth to the fourteenth aspect, the solid core can comprise reinforced thermoplastic.

In a sixteenth aspect according to any of the twelfth to the fifteenth aspect, the solid core can comprise carbon steel.

In a seventeenth aspect according to any of the twelfth to the sixteenth aspect, at least one or the one or more segments can comprise coiled tubing.

In an eighteenth aspect according to any of the twelfth to the seventeenth aspect, a length of a diameter of the solid core can be substantially equal to a length of a diameter of the production string.

In a nineteenth aspect according to any of the twelfth to the eighteenth aspect, a cross-sectional area of the solid core plus the cross-sectional area of the plurality of production conduits can be substantially the same as a cross-sectional area of the production tubing string.

In a twentieth aspect according to any of the twelfth to the nineteenth aspect, the preventing the through the at least one of the plurality of production conduits can be by at least one of: inserting a plug into the at least one of the plurality of production conduits; dropping a ball into the at least one of the plurality of production conduits; or closing a valve.

In a twenty-first aspect according to any of the twelfth to the twentieth aspect, the method can include actuating one or more packer elements disposed about the production string, thereby pressing the packer element circumferentially against an inner surface of the casing string and aligning the production string such that a central axis of the solid core is coincident with a central axis of the casing string.

In a twenty-second aspect, a method includes disposing a production string in a wellbore, the production string comprising one or more segments each comprising a cylindrical, one-piece, solid core extending substantially the length of the segment and defining a plurality of non-intersecting production conduits extending in parallel through the solid core. The method further includes permitting, as a first instance of produced fluid flow, at least a portion of a main flow of fluid produced from the subterranean zone to flow through a first one of the plurality of production conduits to a surface location while preventing flow through at least a second one of the plurality of production conduits and, in response to an indication of a flow reduction event, as a second instance of produced fluid flow after the first instance, permitting flow through at least the second one of the plurality of production conduits to the surface location.

In a twenty-third aspect according to the twenty-second aspect, the indication of the flow reduction event can be an indication of scaling within the first one of the plurality of production conduits.

In a twenty-fourth aspect according to the twenty-second or the twenty-third aspect, the production string can be not removed from the wellbore between the first instance and the second instance.

In a twenty-fifth aspect according to any of the twenty-second to the twenty-third aspect, the first one of the plurality of production conduits can have a different diameter than the second one of the plurality of production conduits.

What is claimed is:

1. A method comprising:

disposing a production string concentrically and coaxially within a casing string disposed in a wellbore drilled into a subterranean zone, the production string comprising one or more segments each comprising a cylindrical, one-piece, solid core extending substantially the length of the segment, the solid core surrounding and thereby defining a plurality of non-intersecting production conduits extending in parallel through the solid core;

permitting, as a first instance of produced fluid flow, substantially all of the fluid flowing from the subterranean zone to flow through one or more of the plurality of production conduits to a surface location; and in response to an indication of a liquid loading event, as a second instance of produced fluid flow after the first instance, preventing flow through at least one of the plurality of production conduits through which flow was permitted in the first instance, such that a total cross-sectional area of the production conduits through which substantially all of the fluid flowing from the subterranean zone is permitted to flow to the surface location in the second instance is less than a total cross-sectional area of the production conduits through which substantially all of fluid flowing from the subterranean zone surface was permitted to flow to the surface location in the first instance.

2. The method of claim 1, wherein the production string is not removed from the wellbore and no additional tubing is disposed within the production string between the first instance and the second instance.

3. The method of claim 1, wherein the solid core comprises reinforced thermoplastic.

4. The method of claim 1, wherein the solid core comprises carbon steel.

5. The method of claim 4, wherein at least one of the one or more segments comprises coiled tubing.

6. The method of claim 1, wherein a length of a diameter of the solid core is substantially equal to a length of a diameter of the production string.

7. The method of claim 1, wherein a cross-sectional area of the solid core plus the cross-sectional area of the plurality of production conduits is substantially the same as a cross-sectional area of the production tubing string.

8. The method of claim 1, wherein the preventing the flow through the at least one of the plurality of production conduits is by at least one of:

inserting a plug into the at least one of the plurality of production conduits;

dropping a ball into the at least one of the plurality of production conduits; or closing a valve.

9. The method of claim 1, further comprising actuating one or more packer elements disposed about the production string, thereby pressing the packer element circumferentially against an inner surface of the casing string and aligning the production string such that a central axis of the solid core is coincident with a central axis of the casing string.

* * * * *